US010221495B2

(12) United States Patent
Fiorucci et al.

(10) Patent No.: US 10,221,495 B2
(45) Date of Patent: Mar. 5, 2019

(54) ELECTROLYTIC CELL FOR METAL ELECTROWINNING

(71) Applicant: INDUSTRIE DE NORA S.P.A., Milan (IT)

(72) Inventors: Alessandro Fiorucci, Origgio (IT); Alice Calderara, Agnadello (IT); Luciano Iacopetti, Milan (IT); Giuseppe Faita, Novara (IT)

(73) Assignee: INDUSTRIE DE NORA S.P.A., Milan (IT)

( * ) Notice: Subject to any disclaimer, the term of this patent is extended or adjusted under 35 U.S.C. 154(b) by 288 days.

(21) Appl. No.: 14/781,436

(22) PCT Filed: Apr. 3, 2014

(86) PCT No.: PCT/EP2014/056681

§ 371 (c)(1),
(2) Date: Sep. 30, 2015

(87) PCT Pub. No.: WO2014/161929

PCT Pub. Date: Oct. 9, 2014

(65) Prior Publication Data

US 2016/0068982 A1 Mar. 10, 2016

(30) Foreign Application Priority Data

Apr. 4, 2013 (IT) ..... MI2013A0505

(51) Int. Cl.
*C25C 7/06* (2006.01)
*C25C 1/12* (2006.01)
(Continued)

(52) U.S. Cl.
CPC ..... *C25C 7/06* (2013.01); *C25C 1/12* (2013.01); *C25C 7/00* (2013.01); *C25C 7/02* (2013.01); *C25C 7/04* (2013.01)

(58) Field of Classification Search
CPC .... C25C 1/12; C25C 7/00; C25C 7/02; C25C 7/04; C25C 7/06
See application file for complete search history.

(56) References Cited

U.S. PATENT DOCUMENTS 3,029,193 A * 4/1962 Dean ..... C25C 3/26 204/246
3,855,092 A * 12/1974 O'Leary ..... C25B 11/0484 205/625

(Continued)

FOREIGN PATENT DOCUMENTS

WO 2004/007805 1/2004
WO 2009/016190 2/2009

(Continued)

OTHER PUBLICATIONS

International Search Report issued in PCT Application No. PCT/EP2014/056681.

*Primary Examiner* — Ciel P Thomas
(74) *Attorney, Agent, or Firm* — Lucas & Mercanti, LLP

(57) ABSTRACT

The invention relates to a cell for metal electrowinning equipped with a device useful for preventing the adverse effects of dendrite growth on the cathodic deposit. The cell comprises a porous conductive screen, positioned between the anode and the cathode, capable of stopping the growth of dendrites and preventing them from reaching the anode surface.

14 Claims, 1 Drawing Sheet

(51) Int. Cl.

| | |
|---|---|
| ***C25C 7/02*** | (2006.01) |
| ***C25C 7/00*** | (2006.01) |
| ***C25C 7/04*** | (2006.01) |

(56) References Cited

U.S. PATENT DOCUMENTS

| | | | | |
|---|---|---|---|---|
| 4,201,653 | A * | 5/1980 | O'Neill | C25C 7/00 204/263 |
| 4,517,064 | A | 5/1985 | Cook | |
| 4,517,068 | A * | 5/1985 | Hinden | C25B 11/0484 204/282 |
| 5,102,513 | A | 4/1992 | Pelkus | |
| 5,622,615 | A * | 4/1997 | Young | C22B 15/0071 205/576 |
| 6,352,622 | B1 | 3/2002 | Brown et al. | |
| 2005/0067291 | A1* | 3/2005 | Haiki | C25C 1/12 205/111 |

FOREIGN PATENT DOCUMENTS

| | | | | |
|---|---|---|---|---|
| WO | WO-2013037899 | A1 * | 3/2013 | C25C 7/00 |
| WO | 2013/060786 | | 5/2013 | |

* cited by examiner

ELECTROLYTIC CELL FOR METAL ELECTROWINNING

CROSS-REFERENCE TO RELATED APPLICATIONS

This application is a U.S. national stage of PCT/EP2014/056681 filed on Apr. 3, 2014 which claims the benefit of priority from Italian Patent Application No. MI2013A000505 filed Apr. 4, 2013, the contents of each of which are incorporated herein by reference.

FIELD OF THE INVENTION

The invention relates to a cell for metal electrowinning, particularly useful for the electrolytic production of copper and other non-ferrous metals from ionic solutions.

BACKGROUND OF THE INVENTION

Electrometallurgical processes are generally carried out in undivided electrochemical cell containing an electrolytic bath and a multiplicity of anodes and cathodes; in such processes, such as the electrodeposition of copper, the electrochemical reaction taking place at the cathode, which is usually made of stainless steel, leads to the deposition of copper metal on the cathode surface. Normally cathodes and anodes are vertically arranged, interleaved in a face-to-face position. The anodes are fixed to suitable anodic hanger bars, which in their turn are in electrical contact with positive bus-bars integral with the cell body; the cathodes are similarly supported by cathodic hanger bars which are in contact with the negative bus-bars. The cathodes extracted at regular intervals, usually of a few days, to effect the harvesting of the deposited metal. The metallic deposit is expected to grow with a regular thickness over the entire surface of the cathodes, building up with the passage of electric current, but it is known that some metals, such as copper, are subject to occasional formation of dendritic deposits that grow locally at increasingly higher rate as that their tip approaches the surface of the facing anode; inasmuch as the local distance between anode and cathode decreases, an increasing fraction of current tends to concentrate at the point of dendrite growth, until the onset of a short-circuit condition between cathode and anode occurs. This obviously entails a loss of faradic efficiency of the process because part of the supplied current is dispersed as short-circuit current rather than being used to produce more metal. In addition, the establishment of a short-circuit condition brings about a local temperature rise in correspondence of the contact point, which in turn is the cause of damage to the anode surface. With the anodes of the older generation, made out of lead sheets, the damage is generally limited to the melting of a small area around the dendrite tip; the situation is however much more serious when present-day anodes made of catalyst-coated titanium foraminous structures such as meshes or expanded sheets are used. In this case, the lower mass and thermal capacity of the anode, coupled with the higher melting point, often involves widespread damages, with a substantial anodic area that gets entirely destroyed. Even when this doesn't occur, there's the risk that the tip of the dendrite, opening its way across the anode meshes, may get welded thereto, making the subsequent extraction of the cathodes problematic at the time of product harvesting.

In a more advanced generation of anodes, the catalyst-coated titanium mesh is inserted inside an envelope consisting of a permeable separator—for instance a porous sheet of polymeric material or a cation-exchange membrane—fixed to a frame and surmounted by a demister, as described in concurrent patent application WO2013060786. In this case, the growth of dendritic formations towards the anodic surface entails the further risk of piercing of the permeable separator even before they reach the anodic surface, resulting in the inevitable destruction of the device.

It has thus been evidenced the need to provide a technical solution allowing to prevent the harmful consequences resulting from the uncontrolled growth of dendritic deposits on the cathodic surfaces of metal electrowinning cells.

SUMMARY OF THE INVENTION

Various aspects of the invention are set out in the accompanying claims.

Under one aspect, the invention relates to a cell of metal electrowinning comprising an anode with a surface catalytic towards oxygen evolution reaction and a cathode having a surface suitable for electrolytic deposition of metal arranged parallel thereto having a porous electrically conductive screen arranged therebetween and optionally in electrical connection to the anode through a suitably dimensioned resistor. The screen is characterised by a sufficiently compact but porous structure, such that it allows the passage of the electrolytic solution without interfering with the ionic conduction between the cathode and the anode. In one embodiment, the porous screen and the anode are put in communication through a microprocessor configured for detecting an anode-to-screen voltage shift. This has the advantage of providing an early warning whenever a dendrite grows from the cathode surfaces until getting in contact with the porous screen: in such event, the electrical potential of the porous electrically conductive screen shifts towards a more cathodic value so that the voltage between anode and porous screen suddenly increases. In one embodiment, the microprocessor is configured to compare the anode-to-screen voltage to a reference value and send an alert signal whenever the difference between the detected voltage and the reference value exceeds a predetermined threshold. This can have the advantage of timely warning the operators of the plant that the corresponding cell needs maintenance; although a screen of proper porosity can be effectively used to stop the growth of an incoming dendrite, an early maintenance prevents the risk of a local welding of the dendrite tip to the screen itself, which could hinder the extraction of the cathode at the time of harvesting the product.

In one embodiment, the porous screen is provided with a means of vertical displacement actuated by the microprocessor whenever the detected anode-to-screen voltage compared to a reference value exceeds a predetermined threshold. This can have the advantage of breaking the tip of the dendrite before it can get welded to the surface of the screen. The means of vertical displacement may for instance consist of a rod mechanically connecting the screen to a spring actuated by a solenoid commanded by the microprocessor, but other types of displacement means can be designed by a person skilled in the art without departing from the scope of the invention.

In one embodiment, the porous screen and the anode are not in reciprocal electrical connection and the microprocessor has an inlet impedance higher than 100Ω, for instance of at least 1 kΩ and more preferably of at least 1 MΩ. This can have the advantage of providing a cleaner and more reliable anode-to-screen voltage measurement, less dependent from the variation of process conditions such as convective electrolyte motions and local electrolyte concentration.

In one embodiment, the porous screen has a sensibly lower catalytic activity towards oxygen evolution than the anode. By sensibly lower catalytic activity it is intended herein that the surface of the screen is characterised by an oxygen evolution potential at least 100 mV higher than that of the anode surface in typical process conditions, e.g. under a current density of 450 $A/m^2$. The high anodic overvoltage characterising the surface of the screen prevents it from working as anode during the normal cell operation, allowing the lines of current to keep on reaching the anode surface undisturbed. The resistance of the screen can be calibrated to an optimal value through the selection of construction materials, their dimensioning (for example, pitch and diameter of wires in the case of textile structures, diameter and mesh opening in the case of meshes) or the introduction of more or less conductive inserts. In one embodiment, the screen can be made of carbon fabrics of appropriate thickness. In another embodiment, the screen can consist of a mesh or perforated sheet of a corrosion-resistant metal, for example titanium, provided with a coating catalytically inert towards the oxygen evolution reaction. This can have the advantage of relying on the chemical nature and the thickness of the coating to achieve an optimal electrical resistance, leaving the task of imparting the necessary mechanical features to the mesh or perforated plate. In one embodiment, the catalytically inert coating may be based on tin, for example in the form of oxide. Tin oxides above a certain specific loading (over 5 $g/m^2$, typically around 20 $g/m^2$ or more) have proved particularly suitable for imparting an optimal resistance in the absence of catalytic activity towards the anodic evolution of oxygen. A small addition of antimony oxide can be used to adjust the electrical conductivity of tin oxide films. Other suitable materials for achieving a catalytically inert coating include tantalum, niobium and titanium, for example in form of oxides, or mixed oxides of ruthenium and titanium.

In one embodiment, the electrowinning cell comprises an additional non-conductive porous separator, positioned between the anode and the screen. This can have the advantage of interposing an ionic conductor between two planar conductors of the first species, establishing a clear separation between the current flow associated to the anode and the one drained by the screen. The non-conductive separator may be a web of insulating material, a mesh of plastic material, an assembly of spacers or a combination of the above elements. In the case of anodes placed inside an envelope consisting of a permeable separator, as described in concurrent patent application WO2013060786, such role can also be carried out by the same separator.

The person skilled in the art will be able to determine the optimal distance of the porous screen from the anode surface depending on the characteristics of the process and of the overall dimensioning of the plant. The inventors have obtained the best results working with cells having anodes spaced apart by 25 to 100 mm from the facing cathode, with the porous screen placed 1-20 mm from the anode.

Under another aspect, the invention relates to an electrolyser for metal electrowinning from an electrolytic bath comprising a stack of cells as hereinbefore described in mutual electrical connection, for example consisting of stacks of cells in parallel, mutually connected in series. As will be apparent to a person skilled in the art, a stack of cells implies that each anode is sandwiched between two facing cathodes, delimiting two adjacent cells with each of its two faces; between each face of the anode and the relevant facing cathode, a porous screen and an optional non-conductive porous separator will then be interleaved.

Under another aspect, the invention relates to a process of copper manufacturing by electrolysis of a solution containing copper in ionic form inside an electrolyser as hereinbefore described.

Some implementations exemplifying the invention will now be described with reference to the attached drawing, which has the sole purpose of illustrating the reciprocal arrangement of the different elements relatively to said particular implementations of the invention; in particular, the drawing is not necessarily drawn to scale.

DETAILED DESCRIPTION OF THE FIGURES

Figure 1:
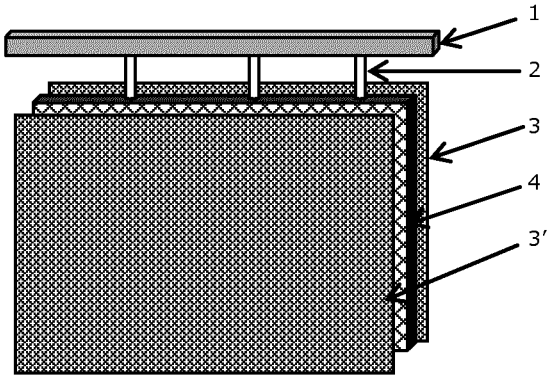
FIG. 1 shows an anodic package including an anode and two porous screens according to one embodiment of the invention.

FIG. 1 shows an anodic package suitable for a metal electrowinning cell wherein 1 indicates an anodic hanger bar for connection to the positive pole of power supply, 2 the connecting supports, 3 and 3' two porous screens vertically arranged face-to-face to either sides of anode mesh 4.

Figure 2:
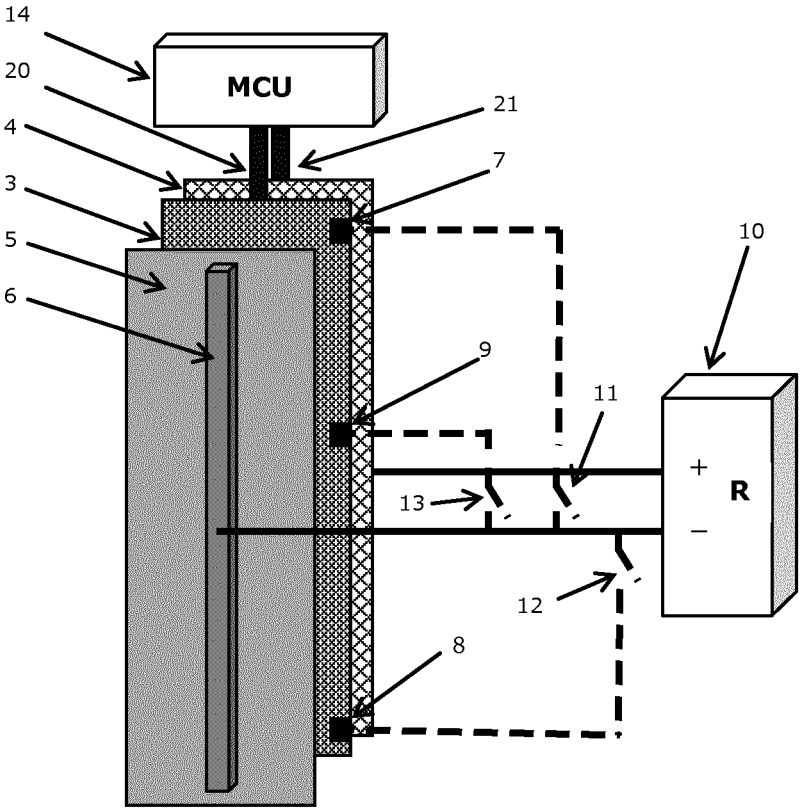
FIG. 2 shows the internal elements of a metal electrowinning cell according to one embodiment of the invention with the relevant connections.

FIG. 2 shows a detail of a test cell for metal electrowinning including an anode mesh 4 and the corresponding cathode 5 vertically arranged parallel to a major surface thereof whereon the product metal (e.g. copper) is deposited, with a facing porous screen 3 arranged in-between; no cathode or porous screen facing the other major surface of anode mesh 4 are provided in this case, nevertheless a person skilled in the art will readily understand the reciprocal arrangement of the repetitive units making up an entire electrolyser, which in principle may be comprised of any number of elementary cells. 6 indicates the cathodic bus-bar connected to the negative pole of power source 10, e.g. a rectifier; 14 indicates the microprocessor used for detecting anode-to-screen electrical voltage values, for comparing the same to a set of reference values and for emitting an alert signal—which may be acoustical, visual or any other type of alerting signal or combination of alerting signals of different types—whenever the anode-to-screen voltage detected exceeds a preset threshold; 20 and 21 indicate connections of microprocessor 14 with screen 3 and anode 4, respectively; 7, 8 and 9 indicate calibrated electrical contacts for short-circuiting screen 3 to the negative pole of power source 10 and hence to cathode 5. Short-circuiting conditions can be established by actuating switches 11, 12 and 13.

The following example is included to demonstrate particular embodiments of the invention, whose practicability has been largely verified in the claimed range of values. It should be appreciated by those of skill in the art that the compositions and techniques disclosed in the example which follow represent compositions and techniques discovered by the inventors to function well in the practice of the invention; however, those of skill in the art should, in light of the present disclosure, appreciate that many changes can be made in the specific embodiments which are disclosed and still obtain a like or similar result without departing from the scope of the invention.

Example 1

A laboratory test campaign was carried out inside a test electrowinning cell according to the embodiment shown in FIG. 2, having an overall cross section of 170 mm×170 mm and a height of 1500 mm. A 3 mm thick, 150 mm wide and 1000 mm high sheet of AISI 316 stainless steel was used as the cathode 5; the anode 4 consisted of a titanium grade 1, 2 mm thick, 150 mm wide and 1000 mm high expanded sheet, activated with a coating of mixed oxides of iridium and tantalum. The cathode and anode were positioned vertically face-to-face spaced apart by a distance of 39 mm between the outer surfaces.

Inside the gap between anode 4 and cathode 5, a screen 3 consisting of a titanium grade 1, 0.5 mm thick, 150 mm wide and 1000 mm high expanded sheet coated with a 10 μm layer of tin oxide, was positioned spaced apart by 5 mm from the surface of anode 4.

Anode 4 and screen 3 were connected through a microprocessor 14 with an inlet impedance of 1.5 MΩ, hence practically insulated from each other. The screen was provided with calibrated contacts 7 and 8 respectively located in correspondence of an upper and a lower corner and 9 located in the middle of a vertical edge, as shown in FIG. 2: such contacts could be short-circuited with the cathode by means of switches 11, 12 and 13.

The cell was operated with an electrolyte containing 150 g/l of $H_2SO_4$, 50 g/l of copper as $Cu_2SO_4$, 0.5 g/l of $Fe^{++}$ and 0.5 g/l of $Fe^{+++}$ at a flow-rate of 30 l/h, keeping the temperature around 50° C. and supplying a direct current of 67.5 A, corresponding to a current density of 450 A/m$^2$. During such electrolysis conditions with switches 11, 12 and 13 in an open position (no short-circuiting conditions) an anode-to-screen cell voltage of about 1 V was detected by microprocessor 14; when any one of switches 11, 12 or 13 was closed, simulating the formation of a dendrite bridging the cathode-to-screen gap, the cell voltage jumped to about 1.4 V. The same experiment was repeated changing the tin oxide coating of the titanium screen with other coatings respectively based on $Ta_2O_5$ and on a mixed oxide of ruthenium and titanium: the response time was slowed down in the former case and sped up in the latter, but the anode-to-screen voltage detected by microprocessor 14 in short-circuiting conditions was very reproducible. By programming microprocessor 14 with a preset threshold of 1.2 V, a reliable alert signal was obtained in every runs of the testing campaign, with the three different screen coating compositions. The alert signal was reproducible also when process conditions such as electrolyte flow-rate and $Fe^{+++}$ to $Fe^{++}$ ratio were altered. The alert signal allows operators to discontinue the operation of an individual cell whenever a dendrite is detected, before the dendrite tip gets welded to the protective screen or starts growing beyond the same. In this regard, it was observed that the useful time for discontinuing the operation of the affected cell can be extended with less resistive coatings. Resistivity of oxide-based screen coatings may be decreased by adding elements of suitable valence, e.g. by doping tin oxide coatings with a small percentage of antimony and the like. Microprocessor 14 can be battery-operated or directly powered by the electrolysis cell voltage as it will be clear to a person skilled in the art.

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

The invention claimed is:

1. Metal electrowinning cell comprising:

an anode with a catalytic surface towards oxygen evolution reaction;

a cathode suitable for metal deposition from an electrolytic bath, arranged parallel to said anode;

an electrically conductive porous screen interposed between said anode and said cathode a microprocessor directly connected to the electrically conductive porous screen and to the anode, the microprocessor configured to detect a voltage between said electrically conductive porous screen and said anode, wherein the surface said electrically conductive porous screen is sensibly less catalytic towards oxygen evolution than said anode, and wherein the electrically conductive porous screen does not interfere with ionic conduction between the anode and the cathode.

2. The cell according to claim 1 wherein said microprocessor is configured to compare said detected voltage between said porous screen and said anode to a reference value and send an alert signal when the difference between said detected voltage and said reference value exceeds a preset threshold.

3. The cell according to claim 2 wherein said porous screen further comprises a means of vertical displacement actuated by said microprocessor when the difference between said detected voltage and said reference value exceeds a preset threshold.

4. The cell according to claim 3 wherein said means of vertical displacement comprises a rod connecting said porous screen to a spring actuated through said microprocessor.

5. The cell according to claim 1 wherein said microprocessor has an inlet impedance of at least 1 kΩ.

6. The cell according to claim 5 wherein said microprocessor has an inlet impedance of at least 1 MΩ.

7. The cell according to claim 1 wherein said porous screen consists of a titanium mesh or punched sheet provided with a coating catalytically inert towards oxygen evolution reaction.

8. The cell according to claim 7 wherein said catalytically inert coating comprises an oxide selected from the group consisting of tin oxides, antimony-doped tin oxides, tantalum oxides and mixed oxides of ruthenium and titanium, at a specific loading higher than 5 g/m$^2$.

9. The cell according to claim 1 further comprising a non-conductive porous separator interposed between said anode and said porous screen.

10. The cell according to claim 1 wherein said anode is inserted within an envelope consisting of a permeable separator surmounted by a demister.

11. The cell according to claim 1 wherein said anode and said cathode are arranged at a mutual distance of 25-100 mm and said anode and said porous screen are arranged at a mutual distance of 1-20 mm.

12. Anodic device for metal electrowinning cells comprising an anode having a catalytic surface towards oxygen evolution reaction connected to a porous screen through a microprocessor configured to detect a voltage between said porous screen and said anode, said screen being arranged parallel to said anode, wherein the surface of said electrically conductive porous screen is sensibly less catalytic towards oxygen evolution than said anode, and wherein the electrically conductive porous screen does not interfere with ionic conduction between the anode and a cathode.

13. Electrolyser for primary metal extraction from an electrolytic bath comprising a stack of cells according to claim 1 in mutual electrical connection.

14. Process for copper manufacturing starting from a solution containing cuprous and/or cupric ions comprising electrolysing the solution inside an electrolyser according to claim 13.

* * * * *